United States Patent [19]

Symons

[11] Patent Number: 4,800,322

[45] Date of Patent: Jan. 24, 1989

[54] BROADBAND KLYSTRON CAVITY ARRANGEMENT

[75] Inventor: Robert S. Symons, Los Altos, Calif.

[73] Assignee: Litton Systems, Inc., Woodland Hills, Calif.

[21] Appl. No.: 106,976

[22] Filed: Oct. 1, 1987

Related U.S. Application Data

[63] Continuation of Ser. No. 663,801, Oct. 23, 1984, abandoned.

[51] Int. Cl.[4] ..... H01J 25/10

[52] U.S. Cl. ..... 315/5.39; 315/5.35; 315/5.43; 315/5.51

[58] Field of Search ..... 315/5.46, 5.37, 5.53, 315/39.53, 5.39, 5.51, 5.52, 5.43, 5.41

[56] References Cited

U.S. PATENT DOCUMENTS

| | | | |
|---|---|---|---|
| 3,195,007 | 7/1965 | Watson et al. | 315/5.43 |
| 3,210,593 | 10/1965 | Blinn et al. | 315/5.43 |
| 3,240,983 | 3/1966 | Biechler | 315/5.39 |
| 3,249,794 | 8/1968 | Staprans et al. | 315/5.43 |
| 3,594,606 | 7/1971 | Lien | 315/5.43 |
| 3,622,834 | 11/1971 | Lien | 315/5.39 |
| 3,688,152 | 8/1972 | Heynisch et al. | 315/5.31 |
| 3,725,721 | 4/1973 | Levin | 315/5.43 |
| 3,775,635 | 12/1973 | Faillon et al. | 315/5.43 |
| 3,811,065 | 5/1974 | Lien | 315/5.43 |
| 3,819,977 | 6/1974 | Kageyama | 315/5.43 |
| 3,942,066 | 2/1976 | Kageyama et al. | 315/5.43 |
| 4,019,089 | 3/1976 | Kageyama et al. | 315/5.43 |
| 4,100,457 | 12/1976 | Edgcombe | 315/5.51 |
| 4,168,451 | 6/1978 | Kageyama et al. | 315/5.39 |
| 4,216,409 | 11/1978 | Sato et al. | 315/5.46 |
| 4,284,922 | 8/1981 | Perring et al. | 315/5.39 |
| 4,558,258 | 12/1985 | Miyake | 315/5.51 |

FOREIGN PATENT DOCUMENTS

| | | | |
|---|---|---|---|
| 0600493 | 4/1948 | United Kingdom | 315/5.43 |

*Primary Examiner*—David K. Moore
*Assistant Examiner*—Michael Razavi
*Attorney, Agent, or Firm*—Poms, Smith, Lande & Rose

[57] ABSTRACT

A klystron having floating cavity clusters, each with two or more closely spaced cavities.

16 Claims, 9 Drawing Sheets

BROADBAND KLYSTRON CAVITY ARRANGEMENT

This is a continuation of co-pending application Ser. No. 663,801 filed on Oct. 23, 1984, now abandoned.

BACKGROUND OF THE INVENTION

1. Field of the Invention

This invention pertains to an improved Klystron for use as a broadband amplifier. The broadband capability occurs because of the particular distribution of cavities along its length. It is believed that the invention is classified in Class 315, Subclass 5.39.

2. Description of the Related Art

The Proceedings of the IEEE, Vol. 70, No. 11, November 1982, on pages 1308–1310 describes broadband klystron theory. FIG. 10 on page 1309 demonstrates the small signal model of a klystron that may be used to describe the operation of the herein described invention. The bibliography on page 1312 is also of interest.

Broadband microwave tubes are necessary for many uses such as sophisticated communications systems, radars, and countermeasures equipments.

See Chapter 10, "Amplifier Klystrons" of "Klystrons and Microwave Triodes" by Hamilton, Knipp and Kuper, MIT Radiation Laboratory Series, McGraw Hill, 1948.

It is customary to space the cavities of a klystron along the beam at substantially equal intervals. For a given number of cavities tuned to the same frequency, such spacing produces maximum gain because the transconductance of each drift length multiplies those of the other drift lengths. If the transconductances of all drift lengths are equal, for a fixed klystron length their product is maximum.

If the drift lengths are not equal, one drift length is made longer by a certain amount and another drift length shorter by the same amount, and further if the transconductance were proportional to the drift length, the product of these two gains or transconductances would be less than for equal drift lengths. In fact, the transconductance is not exactly proportional to the drift length but varies as the sine of the drift length. The gain of an individual drift length becomes maximum at a certain length, and the product of the transconductances is usually even less for unequal drift lengths than it would be if there were a linear relation between drift length and transconductance.

It is common practice to increase the bandwidth of such klystrons at the expense of gain by stagger-tuning the cavities, or tuning them to different frequencies. Note, however, that because the electrons in a klystron beam are not collected at each cavity but travel from each cavity through all the cavities down stream, the current modulation on the beam of a klystron at a certain cavity is due to all the modulations put onto the beam at all upstream interaction gaps. Thus, due to phase cancellations between all the different current modulation signals, there are zeros in the pole-zero response diagram of a stagger-tuned klystron. The number of zeros is equal to the number of floating resonators.

For a klystron with an electron beam of a given length, as more cavities are introduced, first the number of zeros increases, and second the terms of the gain equation which result from the cascading or multiplication of the transconductances of the individual drift lengths and the impedances of the cavities become smaller in relation to the terms of the gain equation caused by signals which miss interaction at one or more cavities. Consequently, the zeros in the frequency response crowd toward the passband, and there is a limit to how much the bandwidth can be increased by merely stagger tuning the larger number of cavities.

While it is possible to increase the bandwidth by spreading the increased number of cavities out over a longer electron beam, it makes the tube physically larger, and it also increases the problems of magnetic focusing of the electron beam and increases the solenoid electro-magnet power or the energy stored in permanent magnets.

U.S. Pat. No. 3,594,606 which issued July 20, 1971 to Erling L. Lien, assigned to Varian Associates, pertains to the use of second harmonic floating cavities or resonators between the output and input cavities. Applicant adopts the definition of floating resonator or floating cavity recited in this patent. As used herein, a "floating resonator" or "floating cavity" is defined to mean a resonator or cavity which does not have any substantial source of energy external to the microwave tube and which is not coupled to a load utilizing the output of the resonator. However, a circuit may optionally be coupled to the floating resonator solely for effecting some electric characteristic of the floating resonator such as its Q or frequency. Second harmonic cavities are spaced-apart along the electron beam with a fundamental frequency cavity therebetween.

U.S. Pat. No. 3,622,834 which issued Nov. 23, 1971 to Erling L. Lien for a "High-Efficiency velocity Modulation Tube Employing Harmonic Prebunching", is assigned to Varian Associates pertains to a klystron having spaced-apart buncher interaction gaps following an especially long drift tube between the input interaction gap and the first buncher interaction gap U.S. Pat. No. 3,725,721 which issued Apr. 3, 1973 to Martin E. Levin for an "Apparatus for Loading Cavity resonators of tunable Velocity Modulation Tubes", assigned to Varian Associates pertains to a klystron having a plurality of spaced-apart tunable floating resonator bunching cavities, each having differing resonant frequencies, stagger tuned to broaden the bandwidth of the klystron, according to prior art, the Q of each cavity being determined by the claimed "loading apparatus".

U.S. Pat. No. 4,100,457 issued July 11, 1978 to Christopher J. Edgcombe for "Velocity Modulation Tubes employing Harmonic Bunching", assigned to English Electric Valve Company, pertains to a klystron having spaced-apart buncher cavities with a long drift tube between the last prebuncher interaction gap and the first buncher interaction gap.

SUMMARY OF THE INVENTION

The present invention describes a way of distributing and increased number of floating resonators along the electron beam of a klystron in such a way that the bandwidth is increased more and the gain increased less than has been possible using prior art.

Instead of distributing the floating pre-buncher and buncher cavities substantially equally in distance along the beam, it is contemplated by this invention to arrange juxtaposed pairs, triplets or higher multiplets of such cavities. While it is preferable that there be no space between the cavities comprising the pairs, triplets or multiplets of cavities, some separation may, in certain situations, be tolerated, but the separation decreases the advantages of this invention.

When the floating cavities are unloaded and tuned to the same frequency, the gain for a klystron in which the cavities are arranged in such pairs, triplets or higher multiplets is lower than it would have been had the cavities been uniformly distributed along the beam. If the cavity Q's are made inversely proportional to the number of floating cavities, the gain is approximately equal to the gain of a klystron having the same number of intermediate cavities as there are cavity pairs, triplets or other multiplets in the klystron of this invention, but the bandwidth is increased almost in proportion to the increased number of cavities.

One explanation is to note that the transconductances of the very short drift lengths between the interaction gaps of each cavity pair, triplet or multiplet, when multipled by the cavity impedances which appear across the interaction gaps of the cavities, produces a loss rather than a gain in the signal level, and hence the gain of the tube is dependent more upon terms which involve only the products of the transconductances of the longer drift lengths and the cavity impedances of the cavities at the ends of those drift lengths. That is, the terms in the gain equation which were unimportant when the cavities were equally spaced now have become important, and the term that was most important when the cavities were equally spaced has now become less important Thus, zeros which previously crowded the edges of the passband are moved out away from the passband by the new cavity arrangement A second, less mathematical explanation is to consider that the currents arriving at all interaction gaps of a cavity pair, triplet, or multiplet as a result of modulation at the beginning of the long drift length upstream from such pair, triplet or multiplet are essentially equal. They excite voltages at each of the interaction gaps within the pair, triplet or multiplet which have a phase relation relative to each other that is dependent upon the phase constant of the beam. All voltages within each pair, triplet or multiplet therefore cooperate to form a new bunch on the beam which is equivalent to the bunch that would have been formed by a single cavity having two, three or more times the impedance of any one of the cavitities within the pair, triplet or multiplet. Consider, then, that each such pair, triplet or multiplet together forms a "floating multiple cavity structure," and it will be so designated herein. The floating multiple cavity structure can be loaded to a Q (where Q is defined as $2\pi$ multiplied by the ratio of energy stored to energy dissipated per cycle) equal to one-half, one-third, or smaller fraction (depending upon whether it is a pair, triplet or higher multiplet, respectively) of that of a single cavity located on the beam of the klystron at that location without reducing the voltage to which the beam is subjected and without reducing the overall gain of the klystron. Because of the reduced Q, the bandwidth is then two, three or more times as great as that of a single cavity with a single interaction gap.

The invention then is a klystron with at least one driving input cavity, at least one driven output cavity, at least one floating cavity cluster positioned along the klystron electron beam between said input and output cavities, each of said cluster of cavities comprising a plurality of cavities with their interaction gaps closely spaced, said cavity clusters being separated from each other and from said input and output cavities by drift tubes, the length of the drift tubes adjacent each cluster being longer than the spacing between the cavities within that cluster. In each klystron the cavities may be tuned either within or without the band. However, it is preferable to tune all cavity clusters, except the last one or two cavity clusters, within the passband. The last one or two cavity clusters, for reason of efficiency, will usually be tuned above the passband.

It is therefore an object of this invention to improve the gain-bandwidth product of a klystron.

It is another object of this invention to improve the bandwidth of a klystron.

Other objects will become apparent from the following description taken together with the accompanying drawings.

DESCRIPTION OF A PREFERRED EMBODIMENT

Figure 1:
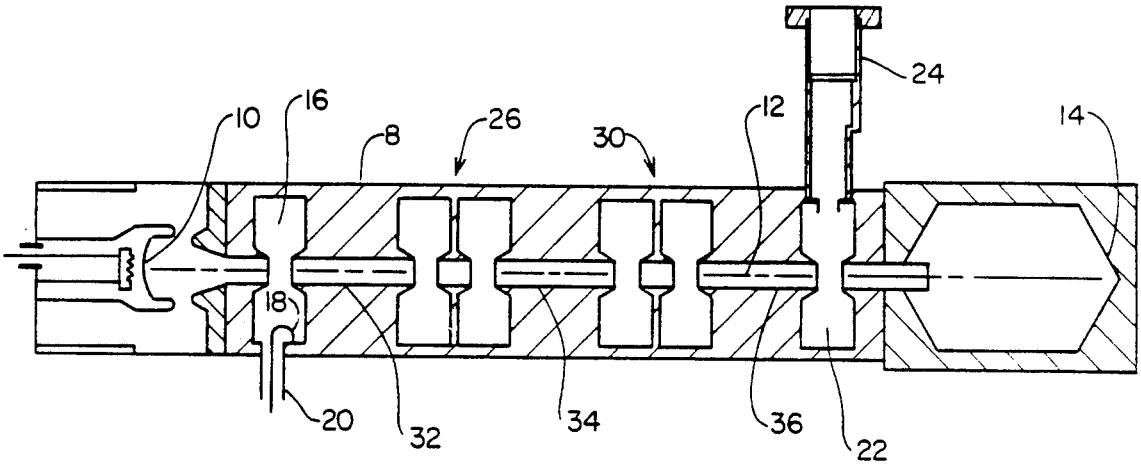
FIG. 1 is a schematic drawing of a klystron according to one embodiment of this invention.

A typical klystron contemplated by this invention is shown in FIG. 1. In FIG. 1, a typical cathode 10 within the evacuated klystron envelope 8 produces an electron stream along the axis 12 of the klystron. The electron stream is collected at the collector 14. No means are shown for focusing the electron stream nor for supplying beam energy to the klystron, but such focusing means and energy supply are provided according to the prior art, typically by magnetic focusing and by a d.c. power supply. An input microwave cavity or resonator 16 is connected, typically by a loop 18 of the center conductor of a coaxial cable 20 to a source (not shown) of microwave energy to be amplified. It must be stressed that the invention is not to be limited to the excitation of the input cavity by such a loop, for there are other means, known to the microwave art, for exciting the input cavity 16. Amplified microwave energy is extracted from the klystron at the output cavity 22. The output cavity is shown coupled to a wave guide coupler 24. Other means known to the microwave art could be used for extracting microwave energy. For example, a loop such as loop 20 could be used for such energy extraction.

In the apparatus of this invention are shown floating multiple-cavity structures or floating cavity clusters 26 and 30 with substantially equal-length drift tubes 32, 34, 36 between clusters and between the clusters and the input and output cavities. Only two clusters 26 and 30 are shown in the FIG. 1, but it is illustrative of the invention only, and more clusters may be used if desired. Further, although substantially equal lengths for the drift tubes 32, 34, 36 are shown, the invention is not to be limited to such equality. Most of the advantages of this invention will be obtained when these drift lengths are merely longer than the drift lengths within each floating cavity cluster.

In prior art klystrons, a single floating cavity would appear where the apparatus of this invention has a cavity cluster. It is the essence of this invention that such clusters replace single cavities. Further, it is contemplated by this invention that the cavity clusters need not be limited to two juxtaposed cavities as shown in FIGS. 1–4, but may have juxtaposed triplets as shown, for example in FIG. 5, or even higher multiplets of such cavities.

While it is preferable that there be no space between the pairs, triplets or multiplets of cavities, some separation may, in certain situations, be tolerated, but the separation decreases the advantages of this invention.

Figure 2:
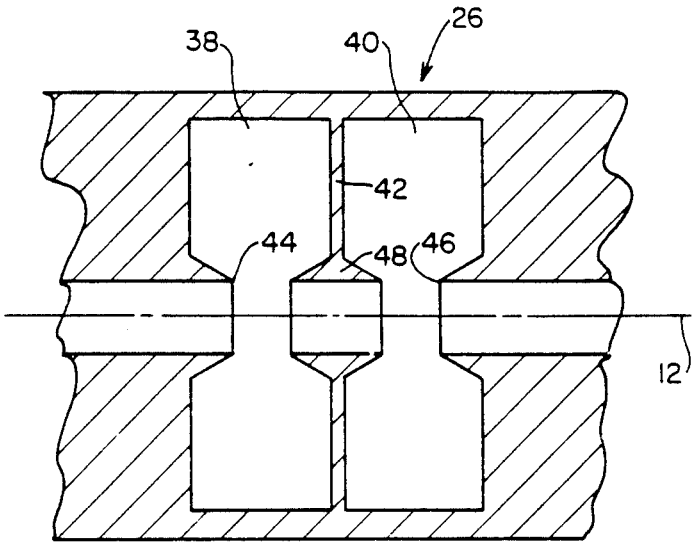
FIG. 2 is a sectional drawing of one embodiment of a pair of adjacent cavities according to this invention.

FIG. 2 shows an enlarged view of the floating cavity cluster 26 (or 30). In this embodiment, the individual cavities 38, 40 are separated by a septum 42, and the throats or entrances 44,46 to the cavities are separated by a short rigid cylindrical ring 48 which is attached to the septum 42. The drift length of the ring 48 is long enough to minimize the electrical capacitance of the throats 44, 46 to each other and to the septum 42. It should be as short as possible to minimize the transconductance between the two cavities.

Figure 3:
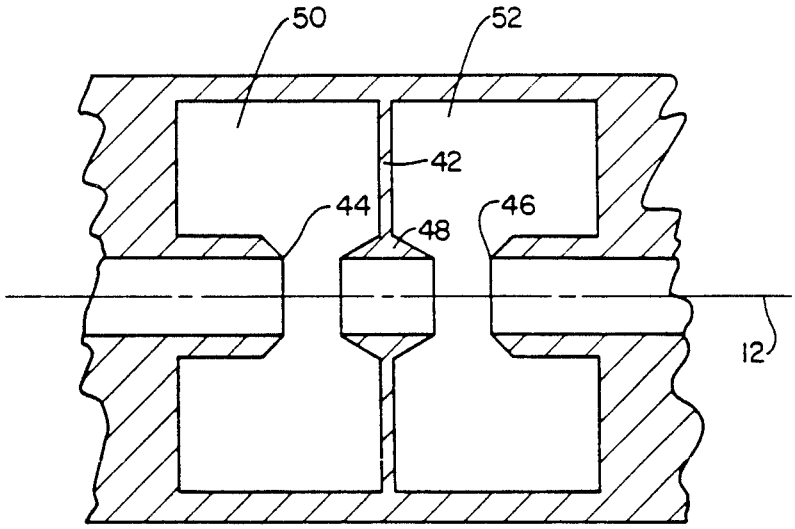
FIG. 3 is a sectional drawing of a second embodiment of a pair of adjacent cavities according to this invention.

FIG. 3 shows two cavities 50, 52 which are larger than those of FIG. 2. Again, gain is minimized between the cavities by keeping the drift length of the ring 48 as short as possible. Note that by using longer entrance throats 44,46 further minimizes the electrical capacitance of the throats 44,46.

Figure 4:
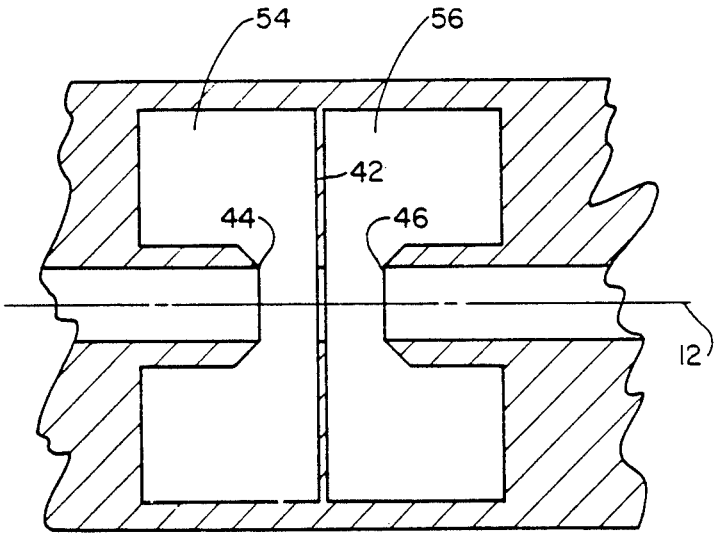
FIG. 4 is a sectional drawing of a third embodiment of a pair of adjacent cavities according to this invention.

FIG. 4 shows an embodiment wherein the entrance interaction gaps of the cavities 54, 56 are separated only by the septum 42. Such structure has the advantage that the short length provides minimum gain between cavities, but the structure may not provide optimum performance because of the increased capacitance from the entrance throats 44,46 to each other and to the septum 42.

Figure 5:
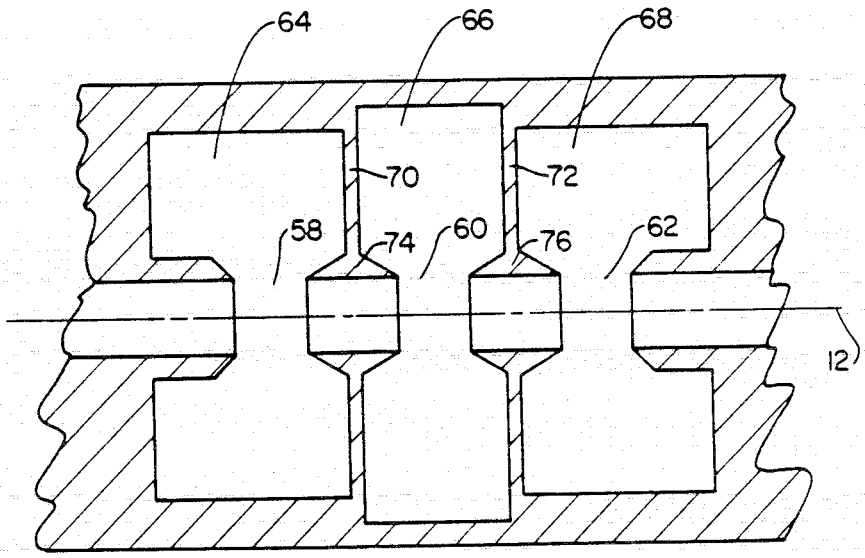
FIG. 5 is a sectional drawing of an embodiment of a triplet of adjacent cavities according to this invention.

FIG. 5 shows a floating cavity cluster wherein the interaction gaps 58, 60, 62 of the cluster of three cavities 64, 66, 68 are substantially uniformly positioned along the electron stream axis 12. Septums 70, 72 separate the cavities 64,66, 68. Rings 74, 76 minimize the capacitance of the gaps and coupling between cavities.

When the floating cavities are unloaded and tuned to the same frequency, the gain of a klystron using such clusters of cavities, whether pairs, triplets or higher multiplets is lower than it would have been had the individual cavities of each cluster been uniformly distributed along the beam. When the Q's are made inversely proportional to the number of cavities, the gain is approximately equal to the gain of a klystron having the same number of intermediate cavities as there are floating cavity clusters, but the bandwidth is increased almost in proportion to the increased number of individual cavities.

One explanation is to note that the transconductances of the very short drift lengths between the interaction gaps of each cavity pair, triplet or multiplet, when multipled by the cavity impedances which appear across the interaction gaps of the cavities, produces a loss rather than a gain in the signal level, and hence the gain of the tube is dependent more upon terms which involve only the products of the transconductances of the longer drift lengths and the cavity impedances of the cavities at the ends of those drift lengths. That is, the terms in the gain equation which were unimportant when the cavities were equally spaced now have become important, and the term that was most important when the cavities were equally spaced has now become less important. Thus, zeros which previously crowded the edges of the passband are moved out away from the passband by the new cavity arrangement.

A second, less mathematical explanation is to consider that the currents arriving at all interaction gaps of a cavity pair, triplet, or multiplet as a result of modulation at the beginning of the long drift length upstream from such pair, triplet or multiplet are essentially equal. They excite voltages at each of the interaction gaps within the pair, triplet or multiplet which have a phase relation relative to each other that is dependent upon the phase constant of the beam. All voltages within each pair, triplet or multiplet therefore cooperate to form a new bunch on the beam which is equivalent to the bunch that would have been formed by a single cavity having two, three or more times the impedance of any one of the cavitities within the pair, triplet or multiplet.

Each such pair, triplet or multiplet together forms a floating multiple cavity cluster of this invention. The floating multiple cavity cluster can be loaded to a Q (where Q is defined as $2\pi$ times the ratio of energy stored to energy dissipated per cycle) equal to one-half, one-third, or smaller fraction depending upon whether it is a pair, triplet or higher muyltiplet, respectively) of that of a single cavity located on the beam of the klystron at that location without reducing the voltage to which the beam is subjected and without reducing the gain. Because of the reduced Q, the bandwidth is then two, three or more times as great as that of a single cavity with a single interaction gap.

The invention then is a klystron with at least one driving input cavity, at least one driven output cavity, at least one floating multiple cavity cluster positioned along the klystron electron beam between said input and output cavities, each of said multiple cavity clusters comprising a plurality of cavities with their interaction gaps closely spaced, said multiple cavity clusters being separated from each other and from said input and output cavities by drift tubes whose lengths are substantially longer than the distance between cavities within a cluster.

FIGS. 6–10 are calculated graphs of gain in decibels for klystrons with the same distances between their input and output cavities but with different cavity configurations.

Figure 6:
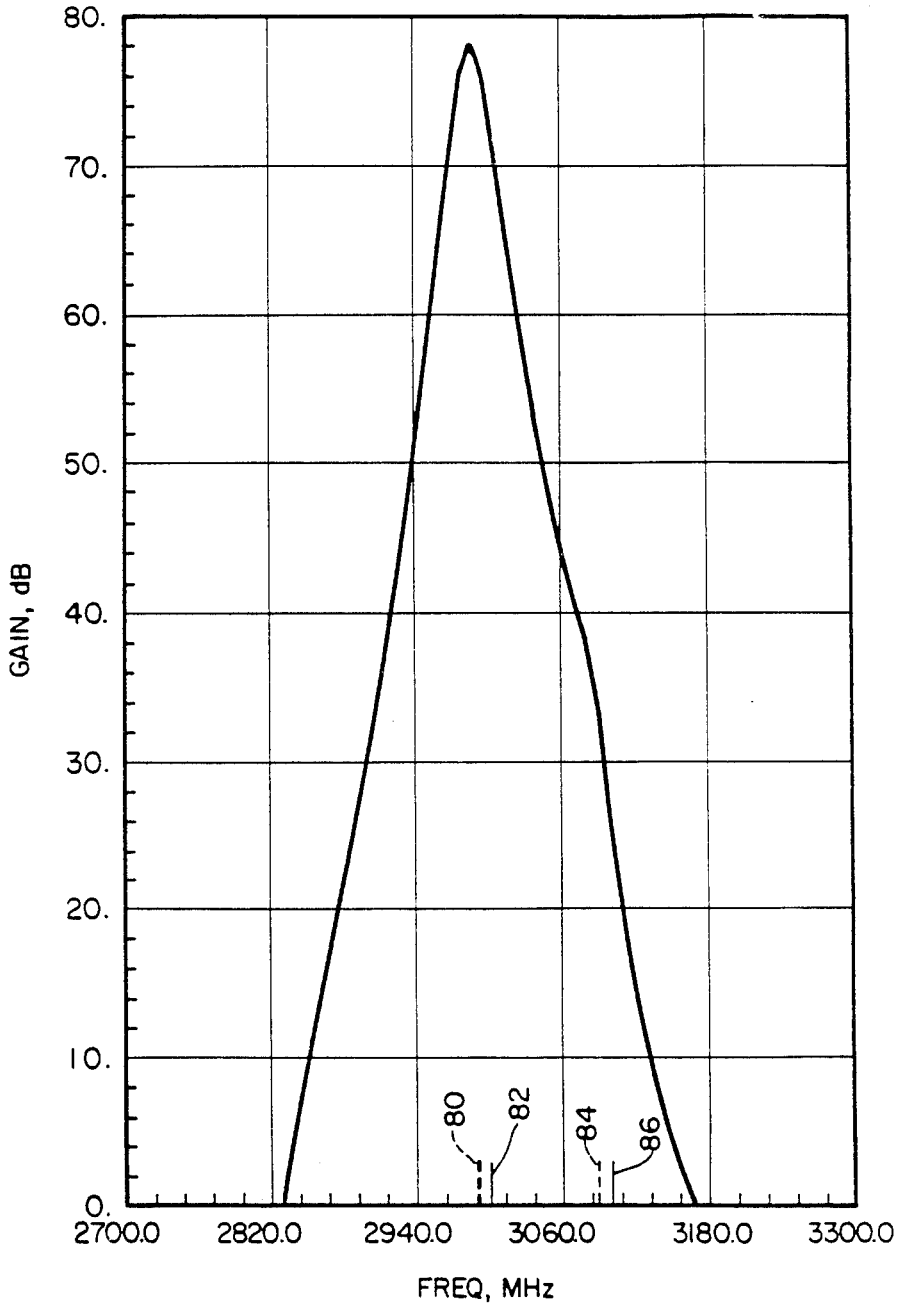
FIG. 6 PRIOR ART
FIG. 6 is a calculated gain-frequency curve for a six cavity prior-art klystron having input and output cavities and four single cavities which are substantially uniformly distributed along the electron stream between the input and output cavities—with all cavities except the penultimate cavity tuned to substantially the same frequency according to the prior art.

The graph of FIG. 6 is for an input cavity, an output cavity and four substantially uniformly spaced floating cavities, according to the prior art, between the input and output cavities. The input cavity and three of the floating cavities are tuned to the same frequency shown by the vertical line 82. As is well known for the usual gap lengths used in klystrons, the presence of the electron beam tunes the cavity to a slightly lower frequency 80. For efficiency, according to the prior art, the fourth floating cavity is tuned to the frequencies represented by 84, 86, and the output cavity is tuned to the frequencies shown by the vertical lines 80, 82.

Figure 7:
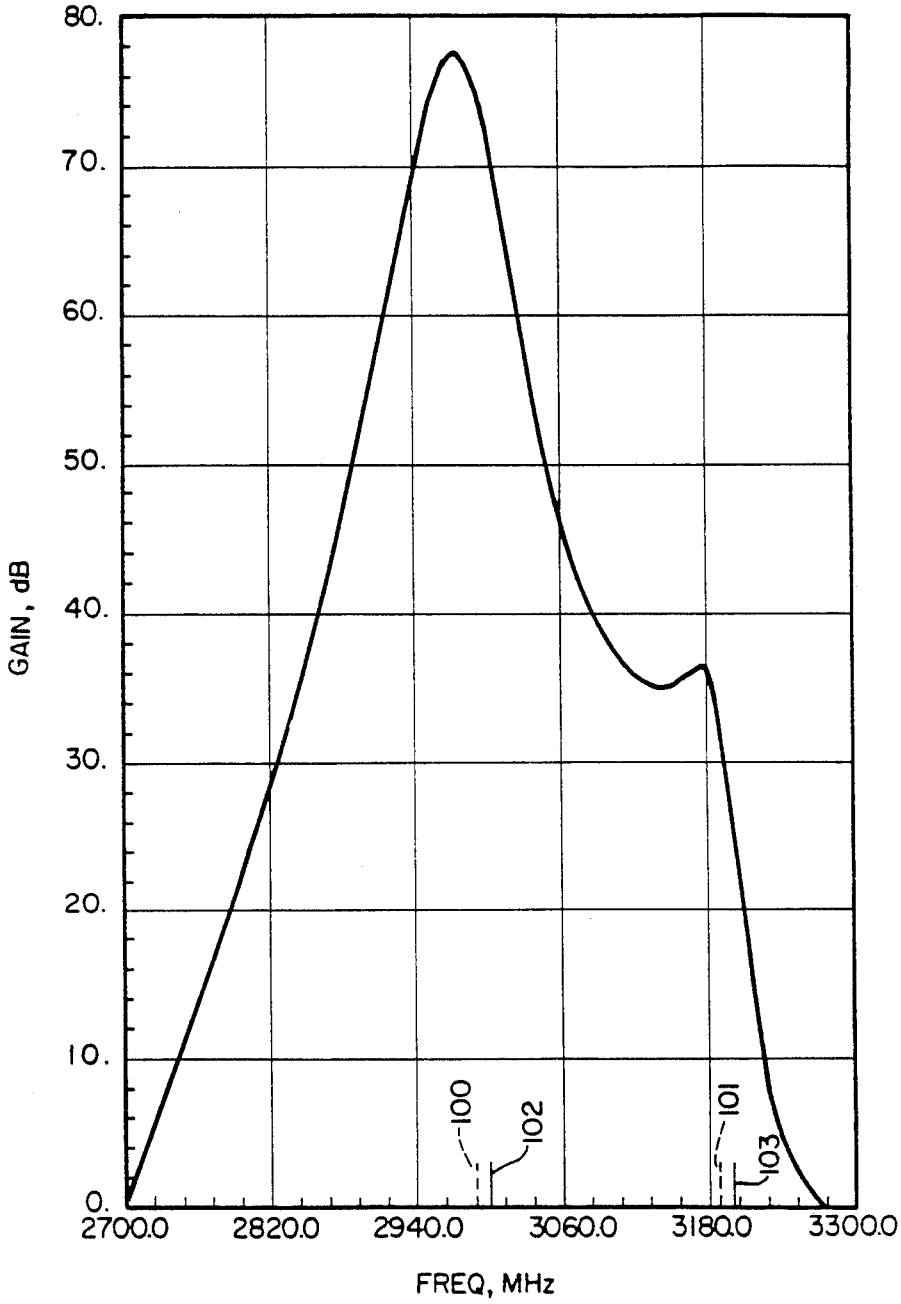
FIG. 7 is a calculated gain-frequency curve for a ten cavity klystron according to this invention having input and output cavities separated by the same distance as for FIG. 6, and four cavity clusters, each cluster comprising a pair of adjacent cavities with adjusted Q, with all cavities except the last cavity cluster tuned to substantially the same frequency.

FIG. 7 is a graph of a klystron incorporating the present invention wherein there is an input cavity, an output cavity, and four floating cavity pairs which replace the individual floating cavities of the klystron which has performance represented in FIG. 6. The input cavity, the output cavity, and the first six floating cavities are tuned to the same frequency 100, 102. Again for efficience reasons, the seventh and eighth floating cavities are tuned to a frequency designated at 101, 103. Note that the bandwidth of this klystron is greater than that of the four floating cavity klystron of FIG. 6.

Figure 8:
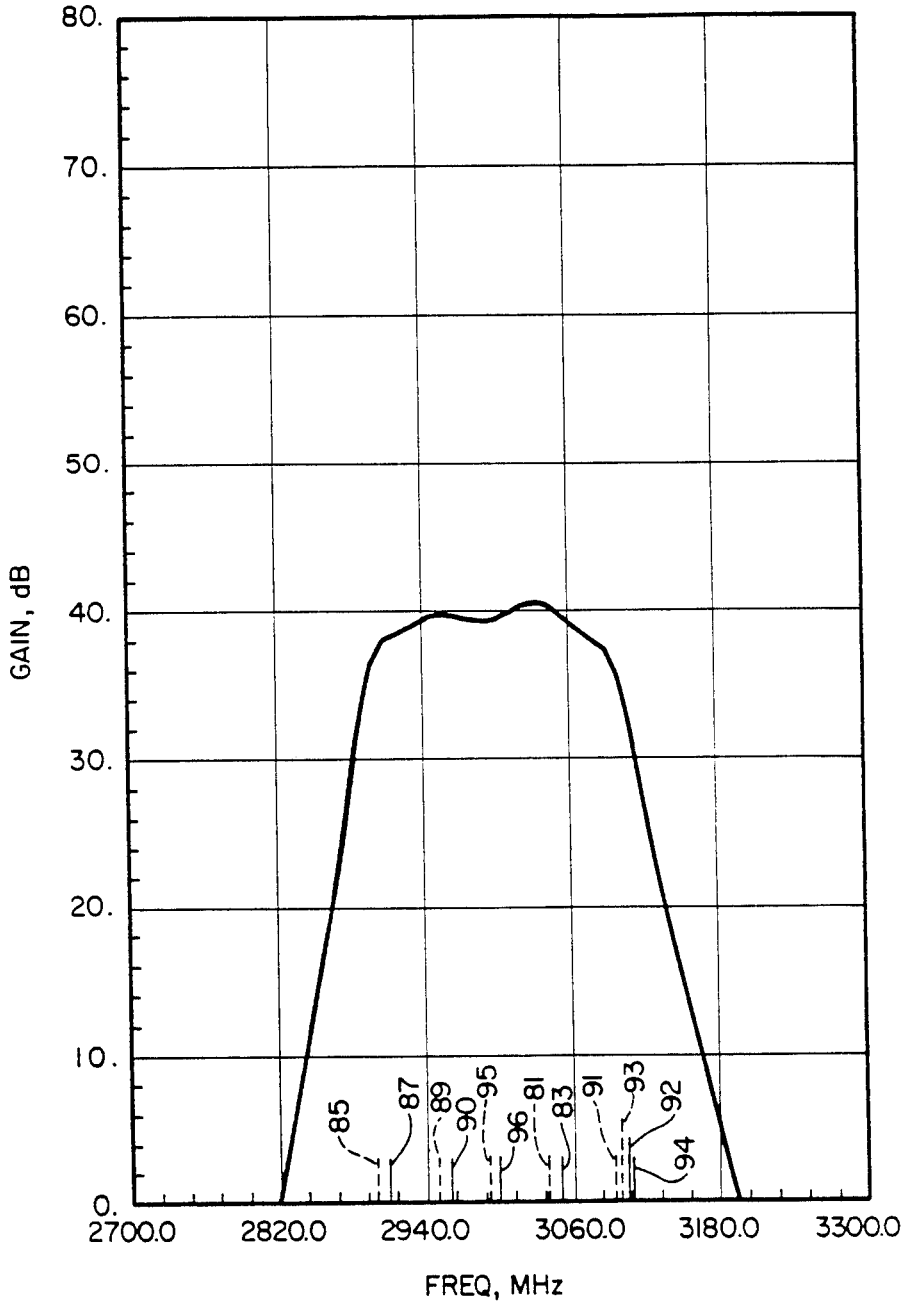
FIG. 8 PRIOR ART
FIG. 8 is a calculated gain-frequency curve for a six cavity prior art klystron having, input and output cavities separated by the same distance as for FIGS. 6 and 7, and four single cavities which are substantially uniformly distributed along the electron stram between the input and output cavities—with the cavity frequencies staggered and adjusted for optimum bandwidth according to the prior art.

The graph of FIG. 8 is for a prior art klystron identical to that for FIG. 6 but wherein the cavities are stagger-tuned. The input cavity is tuned to the frequencies 81, 83. The output cavity is tuned to the frequencies 95, 96. The first floating cavity, numbered from the input to the output cavity, is tuned to the of frequencies 85, 87. The second floating cavity is tuned to the frequencies 89, 90. The third floating cavity is tuned to the frequencies 91, 92. The fourth floating cavity is tuned to the frequencies 93, 94. Notice how the stagger-tuning has dropped the peak gain from about 78 decibels to about 40 decibels, but the bandwidth of the stagger-tuned klystron is broader than that wherein all of the floating cavities were tuned to the same frequency.

Figure 9:
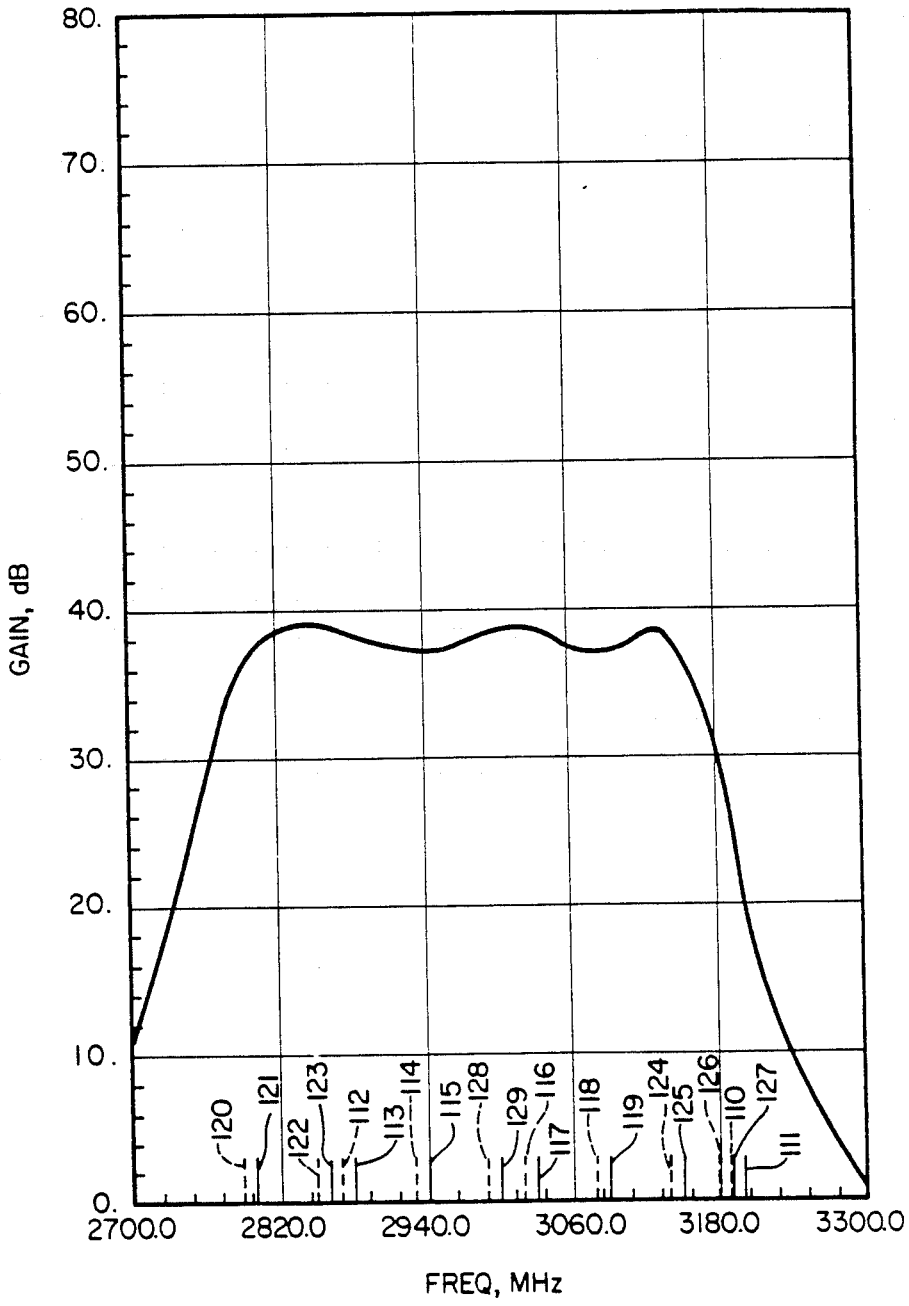
FIG. 9 is a calculated gain-frequency curve for a ten cavity klystron according to this invention having input and output cavities separated by the same distance as for FIGS. 6, 7, and 8 and four cavity clusters, each cluster comprising a pair of adjacent cavities with adjusted Q—with the cavity frequencies staggered for optimum bandwidth.

FIG. 9 shows a graph for the klystron of FIG. 8 wherein the floating cavities of the klystron are replaced by closely spaced cavity pairs according to this invention and are stagger-tuned according to the prior art. The input cavity is tuned to the frequencies 110, 111. The output cavity is tuned to the frequencies 128, 129. The first floating cavity is tuned to the frequencies 112, 113. The second floating cavity is tuned to the frequencies 114, 115. The third floating cavity is tuned to the frequencies 116, 117. The fourth floating cavity is tuned to the frequencies 118, 119. The fifth floating cavity is tuned to the frequencies 120, 121. The sixth floating cavity is tuned to the frequencies 122, 123. The seventh floating cavity is tuned to the frequencies 124, 125. The eighth floating cavity is tuned to the frequencies 126, 127. Note that the bandwidth of this klystron is much greater than the same klystron that is not stagger tuned (FIG. 7) and the same klystron stagger-tuned but with only four floating cavities (FIG. 8).

Figure 10:
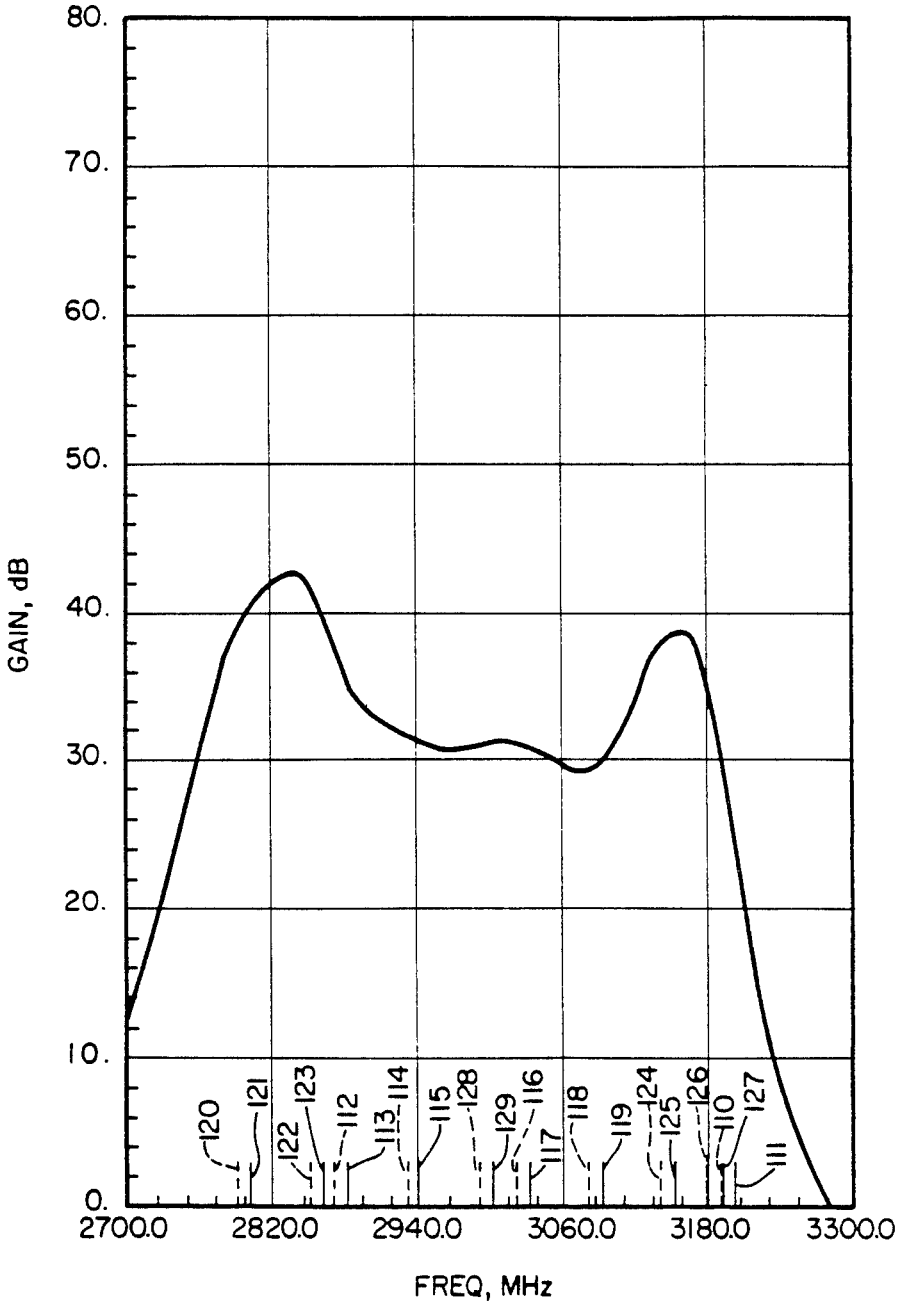
FIG. 10 is a calculated gain-frequency curve for a ten cavity klystron, according to the prior art having input and output cavities separated by the same distance as for FIGS. 6, 7, 8, and 9, and with eight cavities substantially uniformly distributed between the input and output cavities, the individual cavities being tuned to the same frequencies as in FIG. 9.

The graph of FIG. 10 shows a klystron with ten cavities, spaced equally along the beam and separated by equal drift lengths according to prior art and with the individual cavities tuned to the same stagger-tuned frequencies as the ten cavity klystron of FIG. 9. Note that the width of the curve is about the same as that shown in FIG. 9, but the gain is ten db. Lower over a large part of the band. This demonstrates the increase in gain-bandwidth product produced by this invention as shown in FIG. 9.

Thus, the apparatus of this invention is a floating cavity cluster for klystrons and the klystron with such floating cavity structure wherein each cavity cluster comprises a plurality of juxtaposed tuned cavities.

More particularly it is a klystron wherein there are a plurality of such floating cavity structures or clusters with adjacent drift lengths that are longer than the drift length between adjacent cavities within the cluster.

Note that the tuning of the cavities may be accomplished, according to the prior art by adjusting the dimensions of the cavities or by other known passive or active means.

Although the invention has been described above, it is not intended that the invention shall be limited by that description, but only according to the appended claims.

I claim:

1. In a klystron operating within a predetermined bandwidth or passband, and having means for producing an electron stream along the length thereof including through the section providing gain at least one input cavity having means for introducing microwave energy into said klystron, and at least one output cavity for extracting microwave energy therefrom, the cavities being separated by drift tubes of predetermined drift lengths, the improvement comprising:

a plurality of floating cavity clusters positioned along and coupled only to said electron stream between said input and output cavities, each of said clusters comprising a plurality of juxtaposed cavities having closely spaced interaction gaps; and the drift lengths between said clusters being greater than the drift length between adjacent cavities of the individual clusters.

2. In a klystron as recited in claim 1, the improvement further comprising the drift lengths between said clusters, the drift length between said clusters and said input cavity, and the drift length between said clusters and said output cavity being greater than the drift length between adjacent cavities of the individual said clusters.

3. In a klystron as recited in claim 2, the improvement further comprising that the individual cavities of each cluster are each tuned within the passband.

4. In a klystron as recited in claim 3, the improvement further comprising that the cavities of the last said cluster are tuned above the passband.

5. In a klystron as recited in claim 4, the improvement further comprising that the cavities of the penultimate floating cluster are tuned above the passband.

6. In a klystron as recited in claim 2, the improvement further comprising substantially equal drift lengths between said floating cavity clusters.

7. Apparatus as recited in claim 1 wherein each said cluster comprises two closely spaced cavities.

8. The invention of claim 1 wherein each said cavity cluster comprises three closely spaced cavities.

9. The invention of claim 1 wherein adjacent said cavities of each of said cavity clusters are separated by a septum.

10. The invention of claim 9 wherein said septums form openings therein to allow flow of said electron stream.

11. The invention of claim 10 and further comprising at least one ring, each within a separate one of said openings, surrounding said electron stream and each attached to one adjacent said septum.

12. The invention of claim 1 wherein said interaction gaps are juxtaposed.

13. In a klystron as recited in claim 2, the improvement further comprising that at least one of the drift lengths between said clusters, between said clusters and said input cavity, and between said clusters and said output cavity has a length unequal to the length of at least one of the remaining drift lengths between said clusters, between said clusters and said input cavity, and between said clusters and said output cavity.

14. In a klystron operating within a bandwidth or passband, and having means for producing an electron stream along the length one input cavity having means for introducing microwave energy into said klystron, and at least one output cavity for extracting microwave energy therefrom, the improvement comprising:

a plurality of floating cavity clusters positioned along and coupled only to said electron stream between said input and said output cavities, each of said clusters comprising a plurality of juxtaposed cavities having closely spaced interaction gaps; and said cavity clusters being separated from each other and from said input and output cavities by drift tubes, the length of the drift tubes adjacent each cluster being longer than the drift spacing between the cavities within that cluster.

15. In a klystron as recited in claim 14, the improvement further comprising that said drift tubes adjacent each cluster are located on both sides of each cluster.

16. In a klystron operating within a predetermined bandwidth or passband, and having means for producing an electron stream along the length thereof including through the section providing gain, at least one input cavity having means for introducing microwave energy into said klystron, and at least one output cavity for extracting microwave energy therefrom, the cavities being separated by drift tubes of predetermined drift lengths, the improvement comprising:

a plurality of floating cavity clusters positioned along and coupled only to said electron stream between said input and output cavities, each of said clusters comprising a plurality of juxtaposed cavities having closely spaced interaction gaps; and the drift lengths between said clusters, the drift length between said clusters and said input cavity, and the drift length between said clusters and said output cavity being greater than the drift length between adjacent cavities of the individual clusters.

* * * * *